US005863175A

United States Patent [19]

Trefz

[11] Patent Number: 5,863,175

[45] Date of Patent: Jan. 26, 1999

[54] LOADING DEVICE FOR MATERIAL ROLLS, PARTICULARLY FOR PAPER ROLLS

[75] Inventor: Wolfgang Trefz, Reutlingen, Germany

[73] Assignee: bielomatik Leuze GmbH & Co., Germany

[21] Appl. No.: 253,679

[22] Filed: Jun. 3, 1994

[30] Foreign Application Priority Data

Jun. 4, 1993 [DE] Germany ..... 43 18 632.7

[51] Int. Cl.[6] ..... B65H 16/06

[52] U.S. Cl. ..... 414/680; 242/559.1

[58] Field of Search ..... 414/680, 733, 414/908, 910, 911; 242/533, 554.1, 559, 559.1

[56] References Cited

U.S. PATENT DOCUMENTS 3,587,888 6/1971 Warren ..... 414/733 X 4,090,624 5/1978 Krein et al. ..... 414/908 X

OTHER PUBLICATIONS

JP 2–182650 A. In: Patents Abstracts of Japan, M–1032, Oct. 4, 1990, vol.14, No.460.

*Primary Examiner*—Donald W. Underwood
*Attorney, Agent, or Firm*—Quarles & Brady

[57] ABSTRACT

The lower movement path (25) of the gripping head (6) of a loading device (1) is straightened with a cam control (14), the latter being located on the side of the associated lift bearing (7) remote from the gripping head (6). Thus, with a single lift drive (19) the loading device (1) can be transferred into a charging position (26), in which a roll (21) can be axially supplied in unhindered manner and then the gripping heads (6) are lowered and without a transverse movement of the roll can be engaged therewith, without this being prevented by the center height (23, 24) of the roll (21, 22).

4 Claims, 4 Drawing Sheets

LOADING DEVICE FOR MATERIAL ROLLS, PARTICULARLY FOR PAPER ROLLS

BACKGROUND OF THE INVENTION

The invention relates to a loading device making it possible to raise large roll bodies weighing up to several hundred or thousand kilograms from a supported position into a working position, so that they can freely rotate or are freely accessible for the removal of the material, e.g. for unwinding a material web. Such rolls can e.g. have a maximum diameter over 1.5 m.

Such loading devices must make it possible to receive rolls having different external diameters, e.g. the minimum roll diameter being approximately 0.50 m. Independently of the diameter differences the receiving shaft of the roll carrier member must be easily alignable with the roll shaft, so that it is possible to engage the roll hub formed by an axle or shaft sleeve with the particular receiving head of the roll support member. For this purpose the roll support member can be controlled in such a way that its receiving shaft, via an aligning path passes over an approximately linear or vertical movement path, which coincides with the axial plane in which are located the roll shafts independently of the roll diameter, if the rolls are made available in a predetermined, supported position.

In order to be able to linearly supply to a loading position in such an arrangement rolls having a maximum external diameter in such a way that without any transverse movement thereof they can be brought into supporting engagement with the roll support member, the latter can be transversely displaceable with a slide, but this leads to a complicated and space-requiring arrangement. In addition, the alignment of the receiving shaft with the particular roll shaft is difficult, because independently of one another the slide must be adjusted transversely to the vertical axial plane of the roll and the roll support member in the vertical direction of the roll to the shaft thereof.

OBJECTS OF THE INVENTION

An object of the invention is to provide a loading device of the aforementioned type, which avoids the disadvantages of known constructions or of the described type and which in particular ensures a simple supply of the rolls and an alignment of the receiving shaft to the roll shaft independently of the spacing of the roll shaft from the support on the basis of its outside width.

SUMMARY OF THE INVENTION

According to the invention this problem is solved by control means, which on the one hand approximately linearly move the receiving shaft of the roll support member over the area in which the roll shafts of the material rolls can be located and on the other are suitable for transferring the loading device into a position, in which the particular roll, independently of its outside width, in an approximately linear longitudinal movement and without driven transverse conveying can be brought into a stationary loading position in such a way that it can be only brought out of the same by movements of the loading device in engagement with the particular roll support member. The control means bring about a continuous, linear forced movement over the aligning path, so that there is no need to match to one another two movements at right angles to one another and which have to be separately driven, so that the receiving shaft can be adjusted coaxially to the roll shaft.

It is conceivable to bring about the straightening of the aligning path of the receiving shaft by a correspondingly controlled drive, which operates as a function of the lift path or stroke, e.g. in the manner of a cam control and forces the receiving shaft into the straightened path. Compared with the roll radius or diameter, the cam control is appropriately at a greater distance from the receiving shaft, so that it does not have to be moved relative to the stationary base of the loading device in order to permit the remaining functions of the latter following the alignment of the receiving shaft with the roll shaft. In addition, the cam control can have a control cam with cam rotors guided therein moving the receiving shaft as a function of the lift path and therefore forcing the straightening of the alignment path.

The construction according to the invention is particularly suitable for those roll support members, which are not moved linearly or via a parallelogram linkage over the lift path and which are instead pivotable in the manner of a rocker arm about a pivot shaft of a lift bearing roughly parallel to the receiving shaft and which project freely towards the receiving shaft from the bearing shaft in the manner of a cantilever. During a pivoting movement about the pivoting shaft over the lift path corresponding to the alignment path, the receiving shaft then performs a trajectory or curved path, which is straightened by the cam control. In the case of a control cam the latter is correspondingly curved or non-linear. If the control cam is on the side of the pivoting shaft remote from the receiving shaft, then the control cam is curved oppositely to the trajectory performed by the receiving shaft about the pivoting shaft of the support bearing.

The lift bearing is movably mounted at right angles to the receiving shaft with respect to the device base, in order to permit a straightening of the alignment path of the receiving shaft. Instead of bringing about this transverse mobility by a linear slide movement, it is appropriate to have a pivoting movement about a bearing shaft roughly parallel to the pivoting shaft or the receiving shaft and whose distance from the pivoting shaft can be much smaller than the distance between the pivoting shaft and the receiving shaft. The pivoting shaft and the bearing shaft are advantageously approximately vertically superimposed, so that very favourable loading conditions occur.

With the control means or the cam control it is possible to simultaneously control the movement of the receiving shaft and their path between the alignment path and the charging position, so that the receiving shaft can be continuously controlled over its entire movement path without having to match to one another transversely positioned movements or without requiring interruptions of the movement sequences for this. For example, the control cam can pass uninterruptedly from the cam portion belonging to the alignment path into a following cam portion, which controls the movement path up to the charging position.

A single drive, which can also comprise several drive units, e.g. cylinder units is sufficient for the control over the straightened alignment path and for the control up to the charging position. However, it is also conceivable to control with a further drive the movement path between the alignment path and the charging position and which then operates synchronously to the lift drive, which moves the receiving shaft over the alignment path. It can be adequate in this case to provide the control cam only for the control over the lift path.

The control means appropriately act on a rod of the lift bearing, along which the particular roll support member is displaceable, in order to axially adjust the roll in the supported state or to align same with a machine processing the material web. The cam control does not concomitantly perform this axial movement and is instead stationary in the vicinity of the associated base, which in a stationary base plate can have the control cam.

BRIEF FIGURE DESCRIPTION

These and further features can be gathered from the claims, description and drawings and the individual features, both singly and in the form of subcombinations, can be implemented in an embodiment of the invention and in other fields and can represent advantageous, independently protectable constructions for which protection is hereby claimed. Embodiments of the invention are described hereinafter relative to the drawings, wherein show:

FIG. 1 A side view of a loading device according to the invention.

FIG. 2 A detail of the loading device of FIG. 1 in plan view.

FIG. 3 Another embodiment in a view corresponding to FIG. 1.

FIG. 4 A further embodiment.

DETAILED DESCRIPTION OF PREFERRED EXAMPLE EMBODIMENTS

Figure 1:
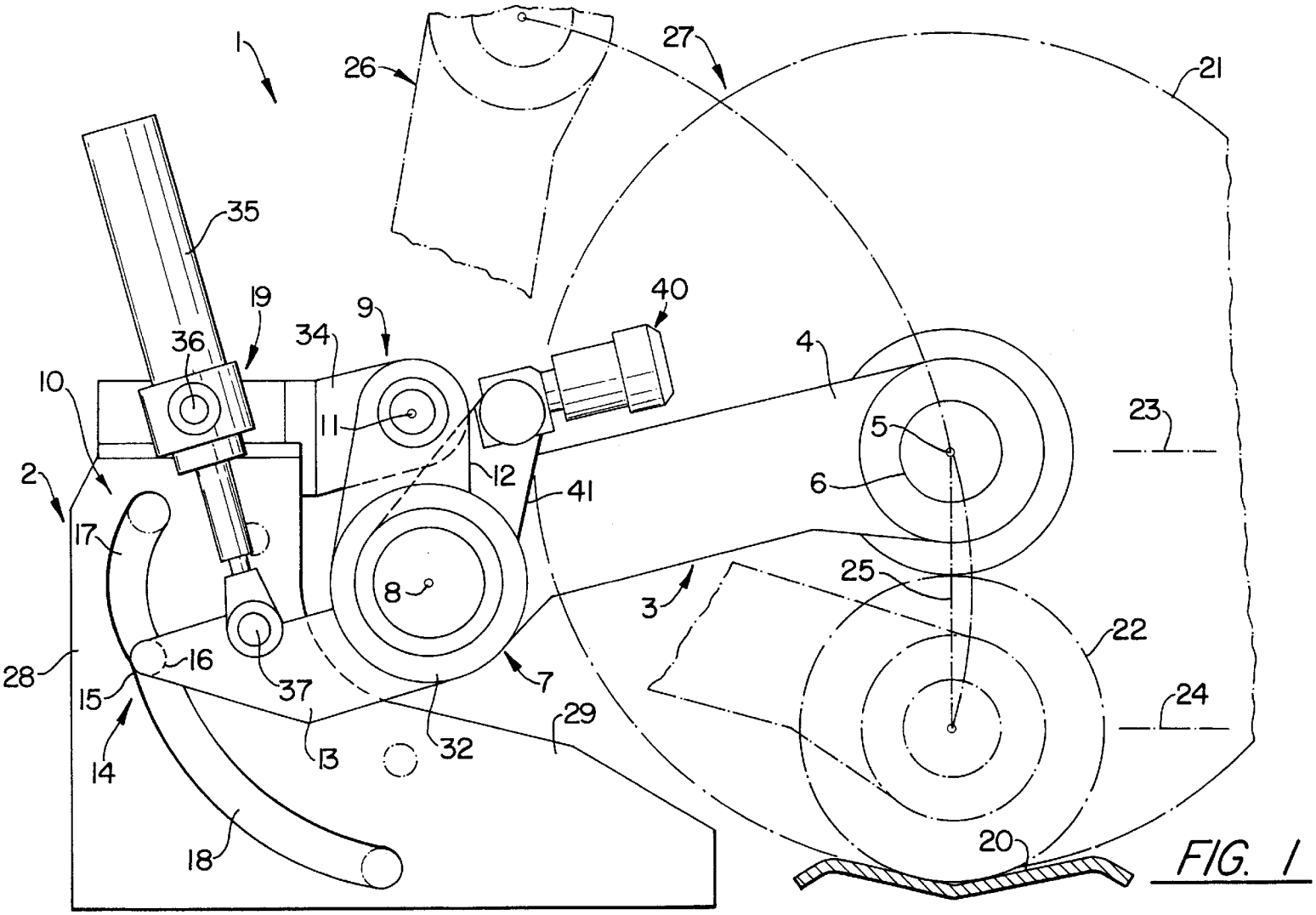

The loading device 1 has a stationary device face 2 and a roll support member 3 movably mounted thereon for performing lifting and deflection movements and which at the end of an exposed support portion 4 is provided with a gripping and receiving head 6, which defines a horizontal receiving shaft 5. The lift bearing 7 is constituted by a pivot bearing with a bearing shaft 8 horizontal or parallel to the receiving shaft 5 and about which the support member 3 only has to be pivoted over an arc angle of approximately 90° for performing the necessary functional movements.

The lift bearing 7 is movable approximately horizontally or transversely to the receiving shaft 5 with respect to the base 2 and for this purpose is pivotably mounted about a pivoting pin or shaft 11 in a support bearing 9 and which is roughly parallel to the shaft 5 or 8, as well as being in a roughly vertical axial plane with the bearing shaft 8. The maximum necessary pivoting angle for the lift bearing 7 is only a few radians, namely less than 10° or 5°, the distance between the shafts 8, 11 being smaller than half the distance between the shafts 5, 8 or approximately one-third thereof. Therefore the lift bearing 7 or the support portion 4 can perform with the gripping head 6 a transverse or horizontal movement synchronously super-imposed on its lift movement in such a way that the receiving shaft 5, in place of a purely curved path about the bearing shaft 8 about a predetermined pivoting angle, performs an approximately linear or vertical movement. This pivoting angle is appropriately below 60° or 45° and is approximately 30°. The support bearing member of the support bearing 7 is suspended on a support guide 12 which is narrower than its outside width and rigidly connected thereto and whose upper end is pivotably mounted about the pivoting shaft 11.

For the continuous movement of the support portion 4 over the straightened movement path and beyond control means 10 are provided, which are substantially completely located on the side of the shafts 8, 11 or the lift bearing 7 remote from the receiving shaft 5 and the support bearing 9 is essentially at the same height as the straightened movement path. On the side remote from the support member 3 a control arm 13 connected thereto so as to engage positively with respect to rotational motion projects over the bearing shaft 8, with which on the one hand moves the gripping head 6, the support portion 4 or the complete support member 3 in its longitudinal direction or approximately in the direction of the connecting lines between the shafts 5, 8, namely can be pivoted about the pivoting shaft 11, and with which on the other hand the gripping head 6 with the support member 3 can be moved vertically or about the bearing shaft 8. As a result of the described construction the gripping head 6 or support portion 4 does not have to be adjustable with respect to the remaining support member 3 in its longitudinal direction and instead the complete support member 3 performs the movement, which is necessary for straightening the movement path otherwise curved about the bearing shaft 8.

The control means 10 have a cam control 14 acting directly on the control arm 13, which in forcibly guided manner leads to a movement of the support unit comprising the support member 3 and the lift bearing 7 about the pivoting shaft 11 namely in path-dependent manner about the bearing shaft 8 with respect to the lifting and pivoting path of the support member 3. For this purpose a rotor 16 runs on a control cam 15, which is appropriately arranged in fixed manner on the base 2, so that the control arm 13 at its end remote from the shaft 8 need only be provided with the rotor 16, e.g. a roll and positively engages with said rotor 16 in the control cam 15. The control cam 15 can receive the rotor 16 between facing and roughly parallel cam faces, so that the support member 3 is forcibly guided in both opposite directions about the pivoting shaft 11. The rotor 16 is roughly in a common axial plane with the shafts 5, 8. The control cam 15 extends upwards and downwards over and beyond the height of the bearing shaft 8 and is curved over essentially its entire extension.

Figure 2:
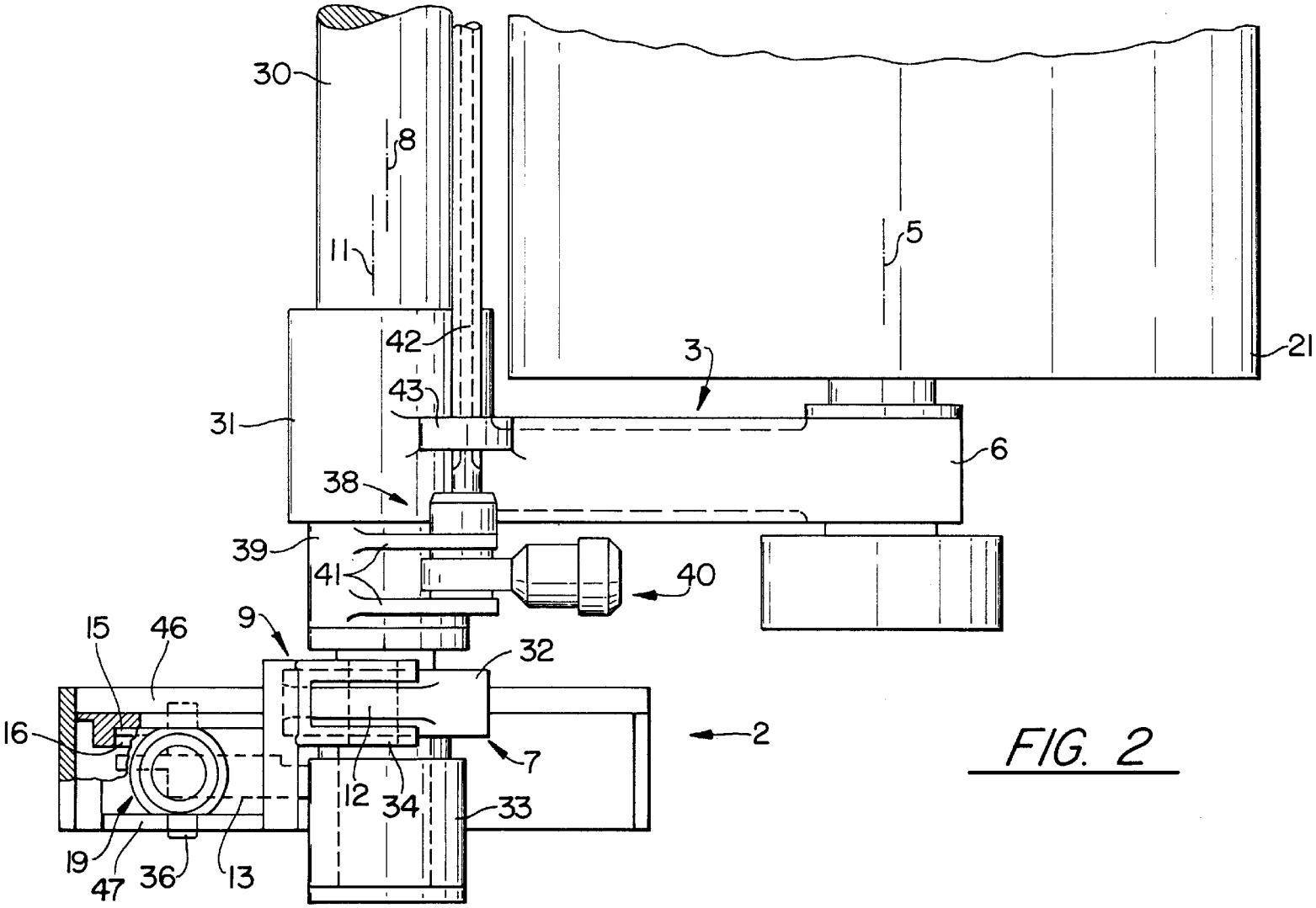

With reference to FIG. 2, the device base 2 includes first and second opposing plates 46 and 47. As shown, the first plate 46 includes the cam curve 15 and the second plate opposes the cam curve 15. As also shown, the cam follower 16 engages between the first and second plates.

A cam portion 17 extending up to an upper end of the control cam 15 is used for the straightening of the movement path and for the stop limitation of the support member 3 in its bottom position. A longer cam portion 18 of the control cam 15 connected in uninterrupted manner to the lower end of the cam portion 17 is used for guiding the support member 3 during movements over and beyond the upper end of the straightened movement path, so that there are no movements about the pivoting shaft 11 and instead the lift bearing 7 is secured in the position which it assumes when the receiving shaft 5 is roughly at the top or bottom end of the straightened movement path. The associated end of the overall movement path of the support member 3 is also stop-limited in that the rotor 16 runs onto the end of the cam portion 18. As the spacing between the rotor 16 from the bearing shaft 8 is roughly half smaller than the spacing between said bearing shaft 8 and the receiving shaft 5, the movement path of the rotor 16 or the length of the cam portion 17 is correspondingly smaller than the straightened movement path of the receiving shaft 5, so that there is here a reduction ratio and a very compact construction. Like the cam portion 17, the cam portion 18 is curved in approximately pitch circular manner, but with a much larger radius of curvature corresponding to its spacing from the bearing shaft 8, whereas the radius of curvature of the cam portion 17 is smaller than its spacing from the bearing shaft 8.

Roughly in the centre between the rotor 16 and the lift bearing 7 a lift drive 19 engages on the control arm 13 in an area which has a greater distance from the bearing shaft 8 than from the rotor 16. By means of the lift drive 19 the support member 3 is moved in its movement path and simultaneously guides the rotor 16 along the cain path 15. In the manner of a linear drive the lift drive 19 engages with a connecting rod directly on the control arm 13 in such a way that it drives both the pivoting movement about the bearing shaft 8 and also that about the pivoting shaft 11.

The rolls 21, 22 are supplied to the loading device 1 by means of a roll support 20, whose obtuse-angled, prismatic bearing surface for the outer circumference of the roll 21, 22 means that the roll shafts assume the same position with respect to the base 2 parallel to the support plane or horizontally, independently of the spacing of the roll shafts from the support due to the different roll diameters. In the case of a maximum diameter of the roll 21 the maximum centre height 23 is obtained, whilst the minimum centre height 24 occurs with the minimum diameter of the roll 22, the maximum centre height being roughly two to three times greater than the minimum centre height 24. The distance between the two centre heights 23, 24 determines the said straightened movement path, namely the alignment path 25, over which the gripping head 6 can also be engaged with any intermediate roll size. This alignment path 25 is so straightened by the cam portion 17 or by a pivoting movement about the pivoting shaft 11 simultaneously with the pivoting movement about the bearing shaft 8 that it is located vertically over the median longitudinal plane of the support 20.

The support 20 is formed by a roll or underground conveyor, which conveys the support 20 with the roll 21, 22 positioned in centred manner thereon parallel to the roll shaft or the receiving shaft 5 from the outside into the working area of the support member 3. So as to be able to transfer more particularly larger rolls 21 past the first support member 3 in the conveying direction and into a position between the facing support members 3, the latter are to be transferred from the upper end of the alignment path 25 upwards and rearwards further into a loading position 26, in which they and all the remaining device parts, considered parallel to tile receiving shaft 5, are located outside the outer circumference of the maximum size roll 21, if the latter is supported on the support 20, which leads to a completely free roll entrance 27.

It should be noted that the device according to the present invention can achieve three basic positions. The first basic position (not explicitly shown in FIG. 1) is the operational supply position which is designated as the "rolling position" or "operating position." When placed in the operating position, roll 21 or 22 is slightly lifted a distance sufficient to be free from ground support 20. This permits the roll to rotate freely and permits unwrapping of the web. The second basic position is the "pick-up position". In this position, the support member 3 is co-axial with roll 21 or 22 when such roll is supported on ground support 20 as shown in FIG. 1. The third position may be referred to as the "charging position" or "roll admitting position" or "loading position". In the roll admitting position, the support member 3 is moved upwardly above the outer circumference of roll 21, 22. This position facilitates axial insertion of roll 21 or 22 along ground support 20 and alignment path 25, even under circumstances where the roll has a maximum diameter.

The movement path from the upper end of the alignment path 25 to the position 26 is a roughly pitch circular curved path controlled by the cam portion 18 and which under an obtuse angle only diverging by a few radians from 180° is connected to the alignment path 25 and whose arc angle can be smaller than 90°. The support axis has a motion path extending beyond the alignment path from the minimum center height to the charging position over an arc angle in a range of not more than 90° to 120°. An alignment means lowers the hoisting axis when the support axis moves along the motion path. As soon as the roll 21 is positioned between the planes of the support member 3, the latter can be pivoted back again, so that the gripping head 6 can be moved unhindered from the outer circumference of the roll 21 along its associated end face into a position where its receiving shaft 5 is approximately epitaxial to the roll shaft. The support members 3 or gripping head 6 are then moved towards one another to such an extent that they engage in the hub opening of the roll 21 or 22 and are consequently positively connected to the roll. Subsequently the support members 3 are moved further upwards into a rolling position by the lift drive 19 in which the material web can be drawn from the outer circumference of the roll 21 for processing purposes. The rolling position can coincide with the charging position 26 or can be between the latter and the upper end of the alignment path 25.

In side view the base 2 is angular with an upright angle leg 28 and an approximately horizontal angle leg connected to its lower end and which projects freely towards the support 20. The two support members 3 are in positive engagement with respect to rotational motion on a common support shaft 30 located in the bearing shaft 8 but are continuously longitudinally displaceably positioned and for this purpose have at the rear end of the support member 3 in each case a support hub 31 surrounding the support shaft 30 and which is spaced with respect to the inside of the associated base 2. The support shaft 30 traverses the reentrant angle between the two base legs 28, 29 of the associated base 2 and, including the lift bearing 7 is positioned below the upper end of the base leg 28 and behind the front end of the base leg 29.

The lift bearing 7 has a bearing outer hub 32 surrounding the support shaft 30 and which is positioned adjacent to the outside of the associated support member 3 in the reentrant angle between the base legs 28, 29 and from whose top surface the support guide 12, connected in shape-rigid manner thereto, projects upwards.

This support guide 12 is pivotably mounted about the pivoting shaft 11 between two support arms 34 freely projecting from the upper end of the base leg 28 roughly parallel to the support member 3, so that the lift bearing 7 with the support shaft 30 can swing in contact-free manner with respect to the base 2 by a few radians about the pivoting shaft 11. The support shaft 30 is freely rotatable in the outer hub 32.

At a limited distance alongside the outside of the lift bearing 7 on the associated end of the support shaft 30 a control hub 33 is positioned so as to engage positively with respect to rotational motion and in axially secured manner and carries the control arm 13, engaging over the base 2 in the plan view according to FIG. 2.

At the lower end of the base leg 28 a cylinder 35 of the lift drive 19 with a drive bearing 36 is pivotably mounted about a shaft roughly parallel to the shafts 5, 8 and 11 and which is located in the vicinity of the lower end of the upright cylinder 35. The end of the suspended piston rod of the cylinder 35 is connected in articulated manner to the control arm 13 by means of a connecting joint 37. When the rotor 16 is located roughly in the transition area between the cam portions 17, 18, the centre axis of the lift drive 19 is roughly at right angles to the axial plane of the rotor 16 and the bearing shaft 8, so that favourable force conditions occur. The control cam 15 extends approximately over the entire height of the base leg 28 and extends with its lower end into the vicinity of the base leg 29. It can be formed by a groove bounded by facing faces and a base surface and therefore only open along one groove opening on the outside of an upright plate of the base 2, a further plate of the base 2 being spaced with respect to the outside of the first plate and the lift drive 19 and the control arm 13 engage between these two plates, so that the control means 10 can be encapsulated and protected in casing-like manner.

The two support members 3 are synchronously displaceable on the support shaft 30 with a longitudinal adjustment means 38 in opposite directions and/or in the same direction. Between the outer hub 32 and the support hub 31 on the support shaft 30 is positioned so as to engage positively with respect to rotational motion, but in axially secured manner a bearing hub 39, so that it is immediately adjacent to the inside of the outer hub 32. Two support arms 41 project upwards and forwards from the bearing hub 39 and between which is fixed a drive 40, e.g. a geared or angle motor and on which is rotatably mounted a regulating or adjusting spindle 42 roughly level with the pivoting shaft 11 in the position of the support member 3 in FIG. 1. The drive 40 above the support member 3 is used for continuously driving the spindle 42 and pivots with the support member 3 about the bearing shaft 8 and the pivoting shaft 11, being positioned behind the latter in the charging position and in front in the loading positions. On the top of the support member 3 and/or the support hub 31 is provided a spindle nut 43 or the like, in which the spindle 42 engages in such a way that rotary movements of the spindle 42 lead to longitudinal displacements of the support member 3. Thus, apart for their engagement movement for engaging in the roll 21 or 22, the support members 3 can also be adjusted to different roll lengths and also in such a way that the roll carried by them is located in the area of different longitudinal portions of the support shaft 30 which is must longer. The adjustability is possible independently of the position of the support member 3.

Figure 3:
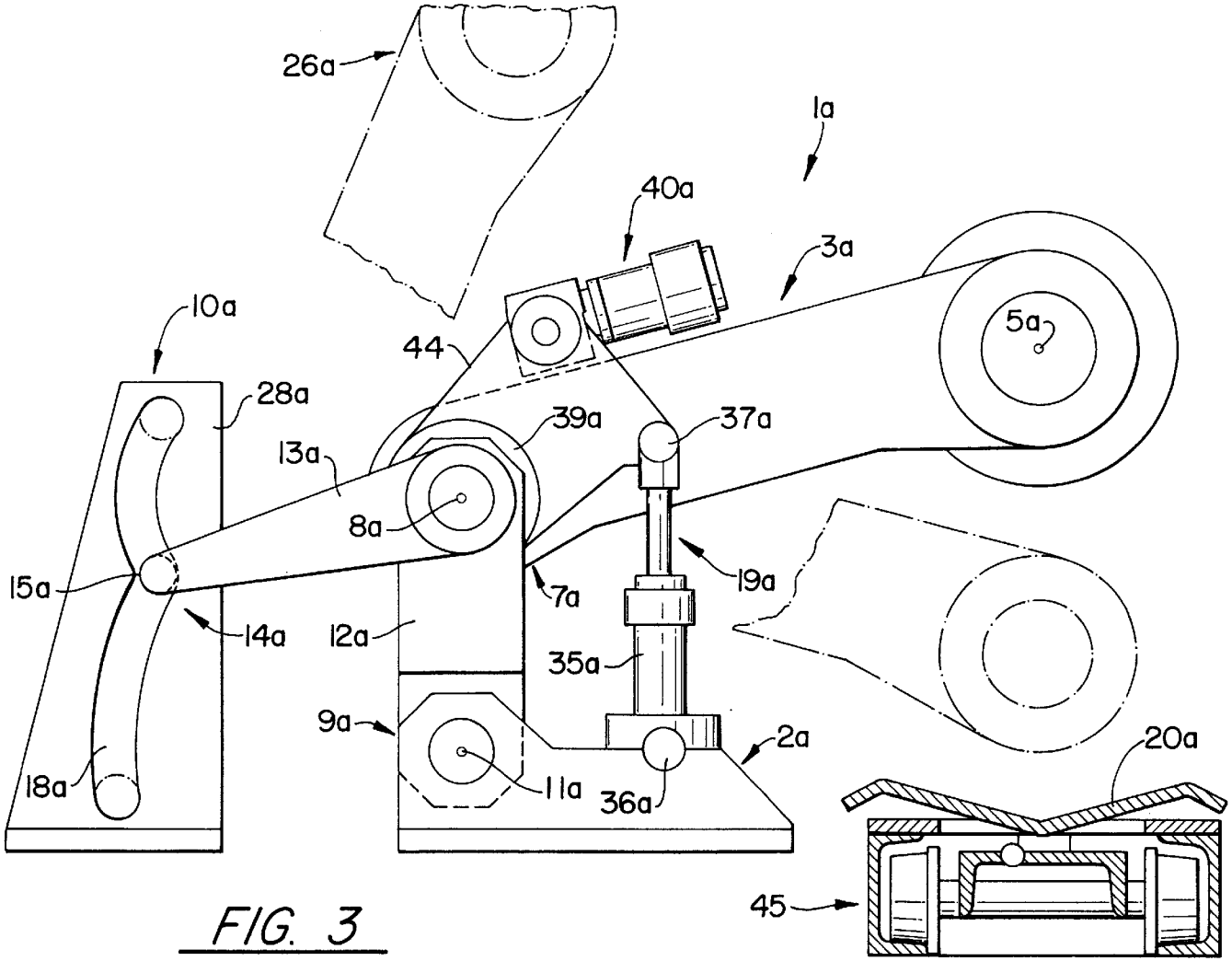
Figure 4:
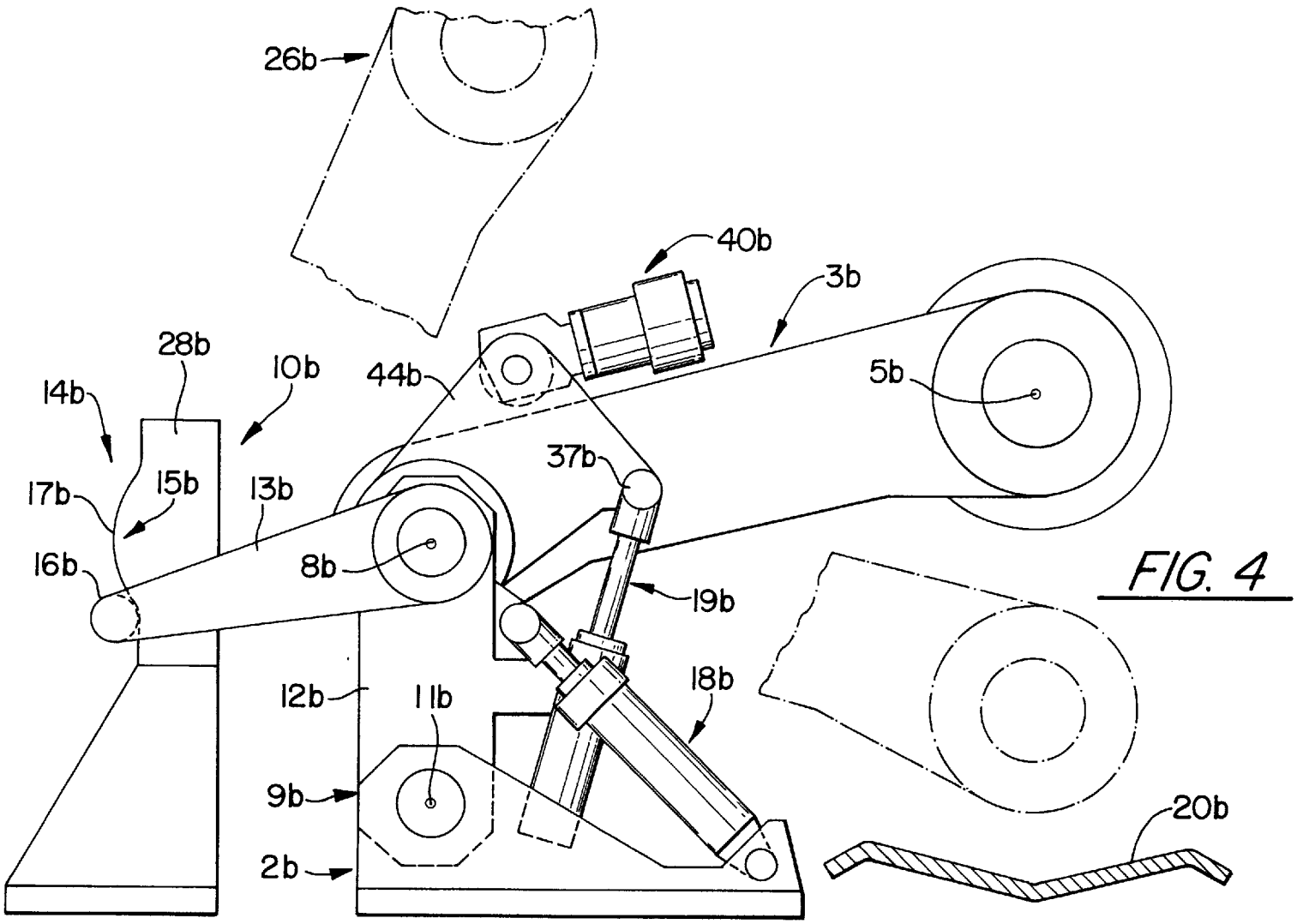

For receiving a roll 21 or 22 the support members 3 are transferred into the charging position 26 and with the support 20 parallel to the receiving shaft 5 the roll is moved into the area between the swung up support members 3. The support members 3 are then lowered and by axial movement their gripping heads 6 are engaged with the roll. During the movement of the receiving shaft 5 over the area between the centre heights 23, 24, the curved path about the bearing shaft 8 is straightened forcibly or positively through the cam portion 17, so that the receiving shaft 5 runs over the vertical alignment path 25. If the roll is raised above the upper end of the alignment path 25, then the cam portion 18 comes into action and moves the receiving shaft 5 to the upwardly projecting charging position 26 of the support member 3 along a curved path or trajectory. As in this case the lift bearing 7 of the support member 3 is suspended on the support bearing 9, the weight of the roll is not or is only insignificantly transferred to the cam control 14, which in this case only prevents the lift bearing 7 from performing pivoting or clearance movements about the support bearing 9. The lowering and placing of a roll to be released on the support 20 takes place in the opposite way. In FIGS. 3 and 4 corresponding parts are given the same reference numerals as in FIGS. 1 and 2, but have different letter references.

According to FIG. 3 the bearing shaft 8 over the alignment path is positioned roughly vertically above the pivoting shaft 11, so that the support guide 12*a* is positioned approximately vertically. The lift drive 19*a* engages on a drive arm 44 separate from the control arm 13*a* and which is positioned with a hub separate from the control hub or with the bearing hub 39*a* on the inside of the support guide 12*a* on the support shaft. Like the lift drive 19*a*, the support guide 12*a* projects over the top of the relatively low base 2*a* and the lift drive 19*a* projecting upwards to the connecting joint 37*a* is positioned upstream of the support guide 12*a* and in each position of the support member 3*a* is roughly parallel to the guide 12*a*. Above the connecting joint 37*a* the drive 40*a* for the longitudinal adjustment means is mounted on the drive arm 44. The cam control 14*a* is provided here on a post 28*a* separate from the base 2*a* and which is spaced behind the latter and whose control cam 15*a* is provided in such a way that its ends are approximately vertically superimposed. The cam portion 18*a* is chosen in such a way that the movement path of the receiving shaft 5*a* is significantly flattened from the upper end of the alignment path to the charging position with respect to a purely circular movement about the fixed bearing shaft 8*a*, because during this movement the bearing shaft 8*a* is pivoted rearwards until in the charging position 26*a* the axial plane of the shafts 8*a*, 11*a* is inclined by roughly 45° rearwards towards the post 28*a* and the bearing shaft 8*a* is much lower than during the movement path over the alignment path.

FIG. 3 shows the conveyor 45 for the support 20*a*. It has driven roll means, which are arranged in individual succeeding manner and carry substantially identical segments of the support 20*a* on their top surfaces.

A similar arrangement and movement path is also provided in the construction according to FIG. 4, but here the control cam 15*b* only has the cam portion 17*b* for the alignment path, whereas the remaining movement path is determined by a cam control, which is brought about by a drive 18*b*. This control drive 18*b* e.g. constructed as a cylinder drive pivots the support guide 12*b* with respect to the base 2*b* in roughly the same way as the cam portion 18*b* according to FIG. 3 and namely simultaneously with the movement of the support member 3*b* through the lift drive 19*b* and/or separately therefrom. During this movement the rotor 16*b* rises completely from the control cam 15*b*,so that the latter is then inoperative. For this purpose in this case the cam portion 17*b* is not formed by a groove, but only by a single convex, circumferential cam or cam face, against which is applied the rotor 16*b* by the control drive 18*b* over the alignment path and from which the rotor 16*b* over the remaining movement path is raised by the control drive 18*b* and by the lift drive 19*b*. The control drive 18*b* can also be positioned substantially upstream of the support guide and in the side view according to FIG. 4 crosses with the lift drive 19*b* in that it is inclined upwards and rearwards from the front end of the base 2*b*. In the loading position the control drive 18*b* is consequently more flatly rearwardly inclined than in the position associated with the alignment path, so that it in no way impedes the insertion of the rolls along the support 20*b*. Correspondingly the lift drive 19*b* is pivoted into a rearwardly inclined release position in the charging position 26*b*.

As a result of the construction according to the invention the loading device can operate completely automatically and a corresponding control device coordinates the described movement sequences, namely transfers the roll into the area of the support member, then engages the latter with the roll and finally raises the latter into the rolling position. Sensors can determine the centre heights as well as the length of the roll and can correspondingly control the roll support members. The removal of a roll can be correspondingly automatically controlled.

I claim:

1. A loading device for charging a supply roll of rolled layer material, the supply roll defining a roll axis, an outer roll circumference and a roll radius extending between the roll axis and the roll circumference, the roll radius defining a radius range between a maximum radius and a minimum radius, when supported in a pick-up position the maximum radius defining a maximum center height and the minimum radius defining a minimum center height, the supply roll having roll end faces, said device comprising:

a roll carrier defining a support axis movable between an operating position and a charging position;

a stationary device base including positioning bearings for positioning said support axis with respect to said devices base, said positioning bearings including a lift bearing defining a hoisting axis and pivotally supporting said roll carrier;

supply means for transferring the supply roll into said pick-up position in an orientation substantially parallel to said support axis and in which said roll carrier can pick up the supply roll independently from the roll radius when said roll carrier is moved from said charging position into said pick-up position, said supply means including a roll support separate from and below said roll carrier, said roll support making the supply roll available for engagement by said roll carrier when the supply roll is in said pick-up position, the maximum and minimum center heights extending upwardly from said roll support;

hoisting means connected between said roll carrier and said stationary device base for positioning said support axis substantially coaxial with the roll axis into an enraged alignment, when the supply roll is supported on said roll support in the pick-up position and for lifting the supply roll from said pick-up position to said operating position in an operating motion transverse to both said support axis and the roll axis, said hoisting means being provided for retracting said roll carrier with respect to said device base into said charging position sufficiently retracted for free passage of the supply roll into and out of said pick-up position while said roll carrier remains in said lift bearings;

alignment means provided between said roll carrier and said stationary device base for aligning said support axis substantially coaxial with the roll axis substantially independent from the roll radius limited by the radius range, when the supply roll is in said pick-up position, said alignment means including cam control means for displacing said support axis with respect to said roll support over a substantially linear alignment path including said engaged alignment, said cam control means including a cam curve and a cam follower guided along said cam curve, said cam curve being non-linear for guiding said support axis along said linear alignment path, wherein said cam curve is stationary and said cam follower pivots about said hoisting axis commonly with said roll carrier;

said roll support including a support face on which the supply roll circumferentially rests when the supply roll is in said pick-up position, said support face including centering means for positively aligning the roll axis with said linear alignment path, irrespective of the roll radius; and, said am control controls said support axis in motion from said pick-up position to said charging position, said cam control being continuous over said alignment path and substatially up to said charging position, said support axis having a motion path extending beyond said alignment path from said minimum center height of said charging position over an arc angle in a range of not more the 90° to 120°, said alignment means lowering said hoisting axis when said support axis moves along said motion path.

2. A loading device for charging a supply roll of rolled layer material, the supply roll defining a roll axis, an outer roll circumference and a roll radius extending between the roll axis and the roll circumference, the roll radius defining radius range between a maximum radius and minimum radius, when supported in a pick-up position the maximum radius defining a maximum center height and the minimum radius defining a minimum center height, the supply roll having roll end faces, said device comprising:

a roll carrier defining a support axis movable between an operating position and a charging position;

a stationary device base including positioning bearings for positioning said support axis with respect to said device base, said positioning bearings including a lift bearing defining a hoisting axis and pivotally supporting said roll carrier;

supply means for transferring the supply roll into said pick-up position in an orientation substantially parallel to said support axis and in which said roll carrier can pick up the supply roll independently from the roll radius when said roll carrier is moved from said charging position into said pick-up position, said supply means including a roll support separate from and below said roll carrier, said roll support making the supply roll available for engagement by said roll carrier when the supply roll is in said pick-up position, the maximum and minimum center heights extending upwardly from said roll support;

hoisting means connected between said roll carrier and said stationary device base for positioning said support axis substantially coaxial with the roll axis into an engaged alignment, when the supply roll is supported on said roll support in the pick-up position and for lifting the supply roll from said pock-up position to said operating position in an operating motion transverse to both said support axis and the roll axis, said hoisting means being provided for retracing said roll carrier with respect to said device base into said charging position sufficiently retracted for free passage of the supply roll into and out of said pick-up position while said roll carrier remains in said lift bearings; and, alignment means provided between said roll carrier and said stationary device base for aligning said support axis substantially coaxial with the roll axis substantially independent from the roll radius limited by the radius range, when the supply roll is in said pick-up position, said alignment means including cam control means for displacing said support axis with respect to said roll support over a substantially linear alignment path including said engaged alignment, said cam control means including a cam curve and a cam follower guided along said cam curve, said cam curve being non-linear for guiding said support axis along said linear alignment path, wherein said cam curve is stationary and said cam follower pivots about said hoisting axis commonly with said roll carrier, wherein said hoisting axis defines a center for a circular arc which extends upwardly from an upper path end of said linear alignment path when said support axis is located at said upper path end, said supply means being provided for transferring said roll support together with the supply roll into said pick-up position, said supply means, said roll support and said roll carrier together defining a roll entrance when said roll carrier is positioned in said charging position, said roll entrance being open for a free and substantially exclusively axial passage of an individual supply roll into said pick-up position, and when starting from said charging position, said roll carrier being movable closely along at least one of the roll end faces over said alignment path, said no alignment means guiding said support axis above said upper path end along a hoisting path located below said circular arc.

3. A loading device for charging a supply roll of rolled layer material, the supply roll defining a roll axis, an outer roll circumference and a roll radius extending between the roll axis and the roll circumference, the roll radius defining a radius range between a maximum radius and minimum radius, when supported in a pick-up position the maximum radius defining a maximum center height and the minimum radius defining a minimum center height, the supply roll having roll end faces, said device comprising:

a roll carrier defining a support axis movable between an operating position and a charging position;

a stationary device base including positioning bearings for positioning said support axis with respect to said device base, said positioning bearings including a lift bearing defining a hoisting axis and pivotally supporting said roll carrier;

supply means for transferring the supply roll into said pick-up position in an orientation substantially parallel to said support axis and in which said roll carrier can pick up the supply roll independently from the roll radius when said roll carrier is moved from said charging position into said pick-up position, said supply means including a roll support separate from and below said roll carrier, said roll support making the supply roll available for engagement by said roll carrier when the supply roll is in said pick-up position, the maximum and minimum center heights extending upwardly from said roll support;

hoisting means connected between said roll carrier and said stationary device base for positioning said support axis substantially coaxial with the roll axis into an engaged alignment, when the supply roll is supported on said roll support in the pick-up position to said operating position in an operating motion transverse to both said support axis and the roll axis, said hoisting means being provided for retracting said roll carrier with respect to said device base into said charging position sufficiently retracted for free passage of the supply roll into and out of said pick-up position while said roll carrier remains in said lift bearings;

alignment means provided between said roll carrier and said stationary device base for aligning said support axis substantially coaxial with the roll axis substantially independent from the roll radius limited by the radius range, when the supply roll is in said pick-up position, said alignment means including cam control means for displacing said support axis with respect to said roll support over a substantially linear alignment path including said engaged alignment, said cam control means including a cam curve and a cam follower guided along said cam curve, said cam curve being non-linear for guiding said support axis along said linear alignment path, wherein said cam curve is stationary and said cam follower pivots about said hoisting axis commonly with said roll carrier; and, said cam curve including two cam sections of different curvatures, said cam sections defining remote stops for said cam follower.

4. A loading device for charging a supply roll of rolled layer material, the supply roll defining a roll axis, an outer roll circumference and a roll radius extending between the roll axis and the roll circumference, the roll radius defining a radius range between a maximum radius and a minimum radius, when supported in a pick-up position the maximum radius defining a maximum center height and the minimum radius defining a minimum center height, the supply roll having roll end faces, said device comprising:

a roll carrier defining a support axis movable between an operating position and a charging position;

a stationary device base including positioning bearings for positioning said support axis with respect to said device base, said support axis with respect to said device base, said positioning bearings including a lift bearing defining a hoisting axis and pivotally supporting said roll carrier;

supply means for transferring the supply roll into said pick-up position in an orientation substantially parallel to said support axis and in which said roll carrier can pick up the supply roll independently from the roll radius when said roll carrier is moved from said charging position into said pick-up position, said supply means including a roll support separate from and below said roll carrier, said roll support making the supply roll available for engagement by said roll carrier when the supply roll is in said pick-up position, the maximum and minimum center heights extending upwardly from said roll support;

hoisting means connected between said roll carrier and said stationary device base for positioning said support axis substantially coaxial with the roll axis into an engaged alignment, when the supply roll is supported on said roll support in the pick-up position and for lifting the supply roll from said pick-up position to said operating position in an operating motion transverse to both said support axis and the roll axis, said hoisting means being provided for retracting said roll carrier with respect to said device base into said charging position sufficiently retracted for free passage of the supply roll into and out of said pick-up position while said roll carrier remains in said lift bearings;

alignment means provided between said roll carrier and said stationary device bade for aligning said support axis substantially coaxial with the roll axis substantially independent from the roll radius limited by the radius range, when the supply roll is in said pick-up position, said alignment means including cam control means for displacing said support axis with respect to said roll support over a substantially linear alignment path including said engaged alignment, said cam control means including a cam curve and a cam follower guided along said cam curve, said cam curve being non-linear for guiding said support axis along said linear alignment path, wherein said cam curve is stationary and said cam follower pivots about said hoisting axis commonly with said roll carrier; and, said device base including first and second opposing plates, said first plate including said cam curve and said second plate opposing said cam curve, said cam follower engaging between said first and second plates.

* * * * *

UNITED STATES PATENT AND TRADEMARK OFFICE

CERTIFICATE OF CORRECTION

PATENT NO. : 5,863,175

DATED : January 26, 1999

INVENTOR(S) : TREFZ

It is certified that error appears in the above-identified patent and that said Letters Patent is hereby corrected as shown below:

Column 5, line 4, replace "cain" with --cam--.

Column 6, line 11, replace "epitaxial" with --equiaxial--.

Column 7, line 38, replace "must" with --much--.

Column 9, line 14, replace "devices" with --device--.

Column 9, line 33, replace "enraged" with --engaged--.

Column 9, line 64, replace "am" with --cam--.

Column 10, line 10, after "defining" insert --a--.

Column 11, line 10, delete "no".

Column 11, line 45, after "position" insert --and for lifting the supply roll from said pick-up position--.

Signed and Sealed this

Sixteenth Day of May, 2000

*Attest:*

Q. TODD DICKINSON

*Attesting Officer*

*Director of Patents and Trademarks*